US010060114B2

(12) United States Patent
Morris et al.

(10) Patent No.: US 10,060,114 B2
(45) Date of Patent: Aug. 28, 2018

(54) CLOSET CARRIER HANDLE ASSEMBLY

(71) Applicant: Zurn Industries, LLC, Milwaukee, WI (US)

(72) Inventors: Jason E. Morris, Erie, PA (US); Robert DiPlacido, Erie, PA (US); Vitaliy Lisichenko, Erie, PA (US)

(73) Assignee: Zurn Industries, LLC, Milwaukee, WI (US)

( * ) Notice: Subject to any disclaimer, the term of this patent is extended or adjusted under 35 U.S.C. 154(b) by 361 days.

(21) Appl. No.: 14/695,094

(22) Filed: Apr. 24, 2015

(65) Prior Publication Data

US 2016/0097191 A1 Apr. 7, 2016

Related U.S. Application Data

(60) Provisional application No. 62/059,352, filed on Oct. 3, 2014.

(51) Int. Cl.
*E03D 11/14* (2006.01)

(52) U.S. Cl.
CPC ..... *E03D 11/14* (2013.01)

(58) Field of Classification Search
CPC ..... E03D 11/14
USPC ..... 4/252.1
See application file for complete search history.

(56) References Cited

U.S. PATENT DOCUMENTS

| | | | | |
|---|---|---|---|---|
| 2,795,798 | A | 6/1957 | Boggess et al. | |
| 3,686,695 | A | 8/1972 | Mielback et al. | |
| 4,637,079 | A | 1/1987 | Hodge | |
| 4,979,239 | A | 12/1990 | Klein et al. | |
| 5,127,131 | A | 7/1992 | Corrigan et al. | |
| 6,035,589 | A | 3/2000 | Schmucki et al. | |
| 6,679,460 | B2 * | 1/2004 | Nicolia | F16L 3/133 248/316.5 |
| 8,141,177 | B1 | 3/2012 | Majocka et al. | |
| 8,468,615 | B2 | 6/2013 | Tremp | |
| 8,540,294 | B2 | 9/2013 | Dowler et al. | |
| 8,579,345 | B2 | 11/2013 | LeClaire et al. | |
| 2004/0133969 | A1 * | 7/2004 | Akin | E03D 11/14 4/252.2 |
| 2004/0154131 | A1 | 8/2004 | Earley et al. | |
| 2009/0160181 | A1 | 6/2009 | Reichmuth | |
| 2010/0019114 | A1 | 1/2010 | Vargo | |

OTHER PUBLICATIONS

Canadian Intellectual Property Office, Office Action, Application No. 2,889,564, dated Apr. 27, 2016.

* cited by examiner

*Primary Examiner* — Tuan N Nguyen
(74) *Attorney, Agent, or Firm* — Quarles & Brady LLP

(57) ABSTRACT

A detachable handle assembly for lifting and transporting a faceplate of a closet carrier system for a water closet includes a handle body; at least one arm extending from the handle body; at least one hook extending from the at least one arm; and at least one latch movably attached to the at least one arm proximate to the at least one hook.

6 Claims, 15 Drawing Sheets

CLOSET CARRIER HANDLE ASSEMBLY

CROSS REFERENCE TO RELATED APPLICATION

The present application claims priority from U.S. Provisional Patent Application No. 62/059,352 filed on Oct. 3, 2014, which is incorporated herein by reference in its entirety.

BACKGROUND OF THE INVENTION

Field of the Invention

The present invention relates to wall-mounted toilets and, in particular, to a carrier or a support system for adequately supporting a toilet and the weight of the user, and for placing the toilet in fluid communication with a waste fitting and a detachable handle assembly for transporting such a carrier prior to installation.

Description of Related Art

Closet carrier systems and fittings are designed for mounting and supporting water closets that include a flush valve or flush tank that flushes the water closet, and for placing such water closets in fluid communication with a waste fitting. An example of a closet carrier of this type is disclosed in U.S. Pat. No. 8,141,177, issued on Mar. 27, 2012, which is assigned to Zurn Industries, LLC, the assignee of the present application, and is incorporated herein by reference in its entirety. The adjustable coupling, faceplate, fitting, and other components of the carrier(s) disclosed therein are configured, both in terms of size and general shape, to convey flush water and waste from a water closet to a waste line. Such carriers can be very heavy and awkward to transport prior to installation.

SUMMARY OF THE INVENTION

Accordingly, there is a general need in the art for a handle or similar device to facilitate in handling, transportation, and installation of carrier assemblies, particularly the faceplates of such assemblies.

According to an embodiment of the present invention, a detachable handle assembly is provided. The detachable handle assembly includes a handle body; at least one arm extending from the handle body; at least one hook extending from the at least one arm; and at least one latch movably attached to the at least one arm proximate to the at least one hook. The detachable handle assembly is configured for lifting and transporting a faceplate of a closet carrier system. The at least one hook and the at least one latch are configured for mutually engaging and holding at least a portion of an object on the detachable handle assembly. The at least one latch is movable with respect to the arm and the at least one hook to selectively engage and disengage at least a portion of the object. The at least one latch includes at least one portion to facilitate handling and movement thereof. The at least one hook and the at least one arm define a U-shaped channel configured to receive and support at least a portion of the object. The at least one hook may extend from an end of the at least one arm. The handle body includes a central gripping portion. The central gripping portion includes at least one ergonomic feature to facilitate gripping. The at least one arm of the assembly may include at least two arms disposed on opposite ends of the central gripping portion. The at least one hook may include at least two hooks, each extending from a respective one of the at least two arms, and the at least one latch may include at least two latches, each movably attached to a respective one of the at least two arms proximate to the respective at least one hook.

According to another embodiment of the present invention, a closet carrier system is provided. The closet carrier system includes a faceplate; a coupling connected to and extending from the faceplate, the coupling being configured to be connected to the water closet and placed in fluid communication therewith; at least one vertical support connected to the faceplate for supporting the system on a floor surface; and a detachable handle assembly for connection to at least a portion of the faceplate. The detachable handle assembly includes a handle body; at least one arm extending from the handle body; at least one hook extending from the at least one arm; and at least one latch movably attached to the at least one arm proximate to the at least one hook. The detachable handle assembly is configured for lifting and transporting the faceplate.

According to another embodiment of the present invention, a method of assembling a closet carrier system for a water closet is provided. The method includes providing a faceplate; providing at least one vertical support, the at least one vertical support being configured to be adjustably connected to the faceplate for supporting the carrier system on a floor surface; providing a coupling, the coupling being configured to be adjustably connected to the faceplate, and configured to be connected to the water closet and placed in fluid communication therewith; providing a detachable handle; connecting the detachable handle to at least a portion of the faceplate; and lifting and transporting at least the faceplate by the detachable handle to an installation site.

Further details and advantages of the invention will become clear upon reading the following detailed description in conjunction with the accompanying drawing figures, wherein like parts are designated with like reference numerals throughout.

DETAILED DESCRIPTION OF THE INVENTION

Figure 1:
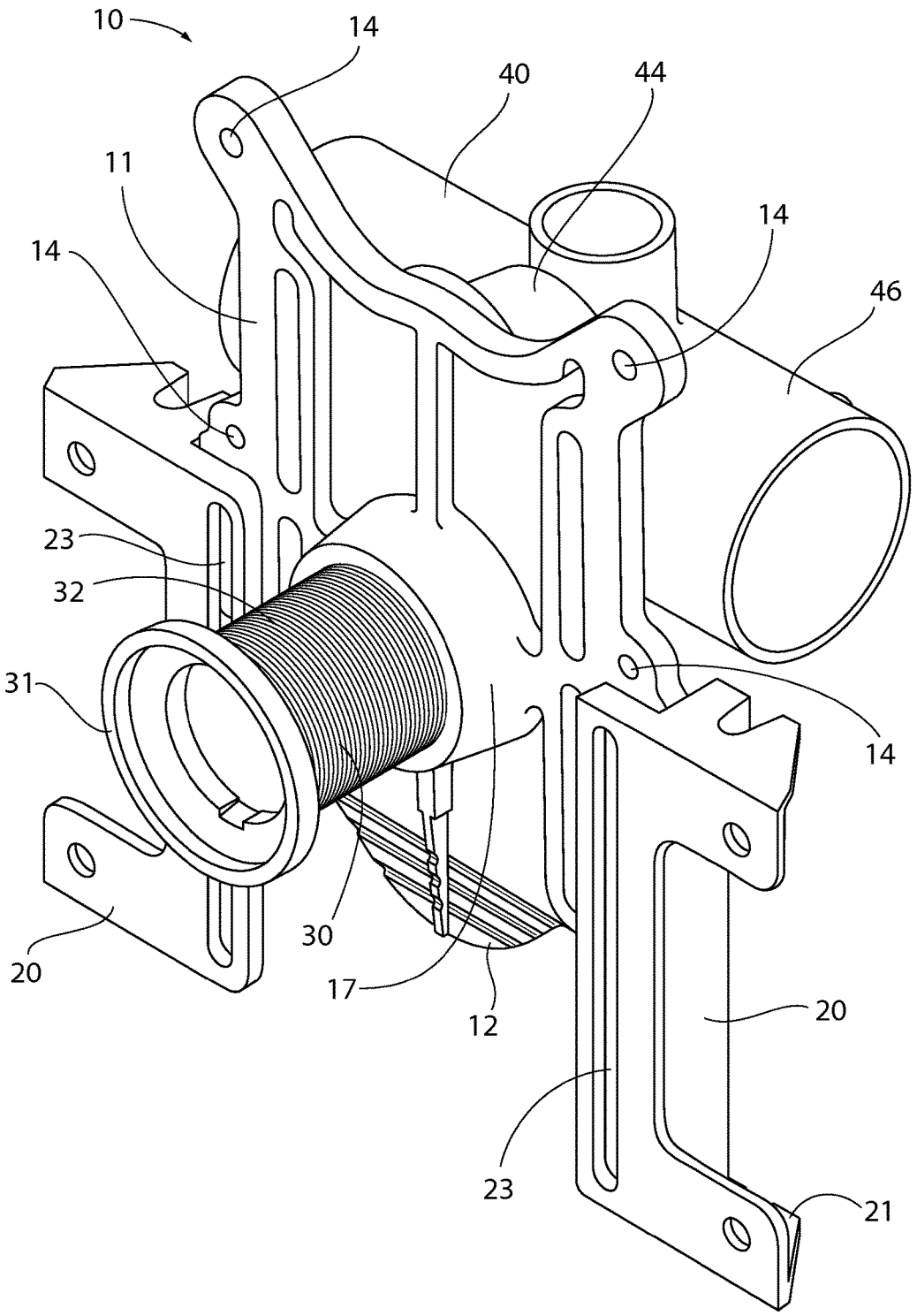
FIG. 1 depicts an upper front perspective view of a closet carrier system in accordance with an embodiment of the present invention.
Figure 2:
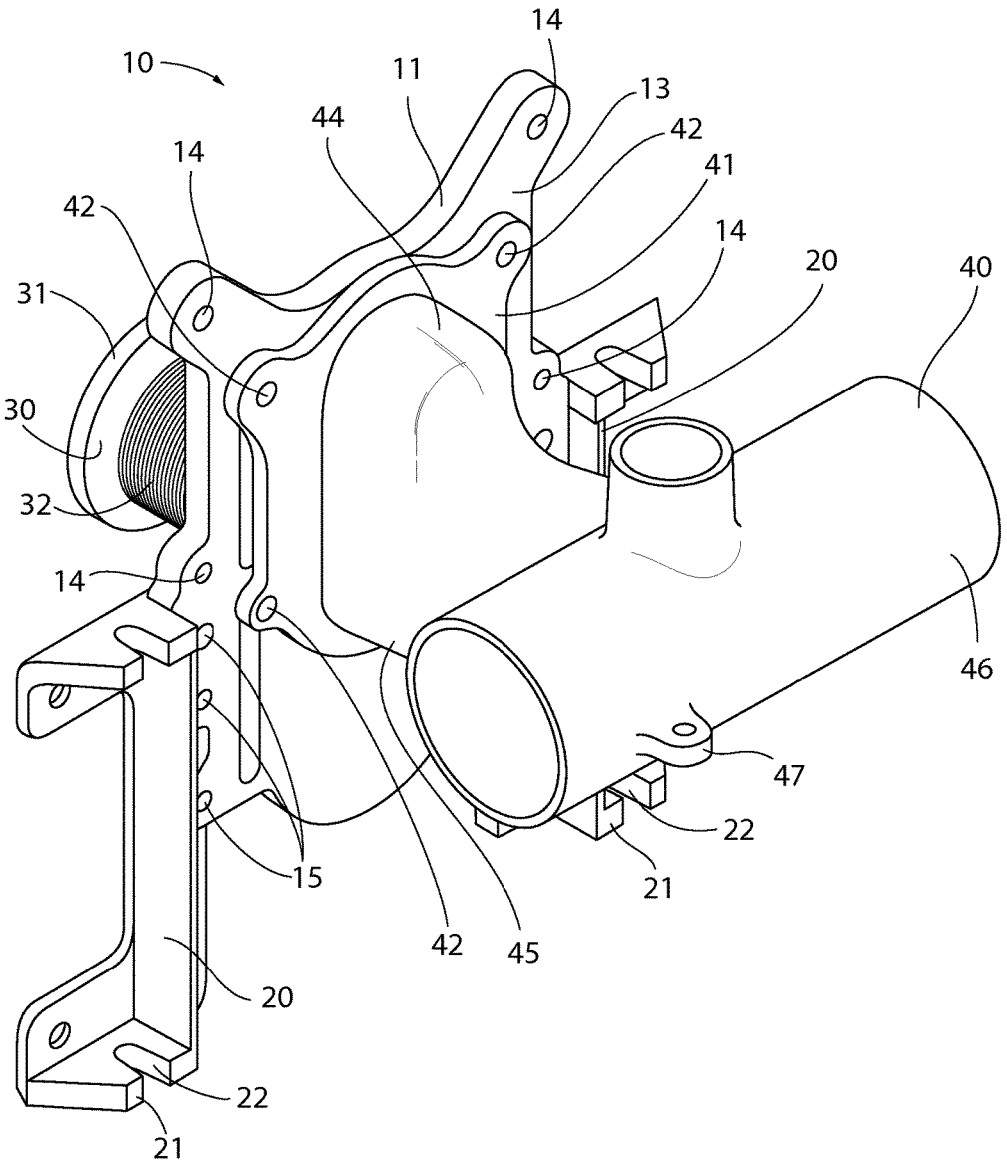
FIG. 2 depicts an upper rear perspective view of the closet carrier system of FIG. 1.
Figure 3:
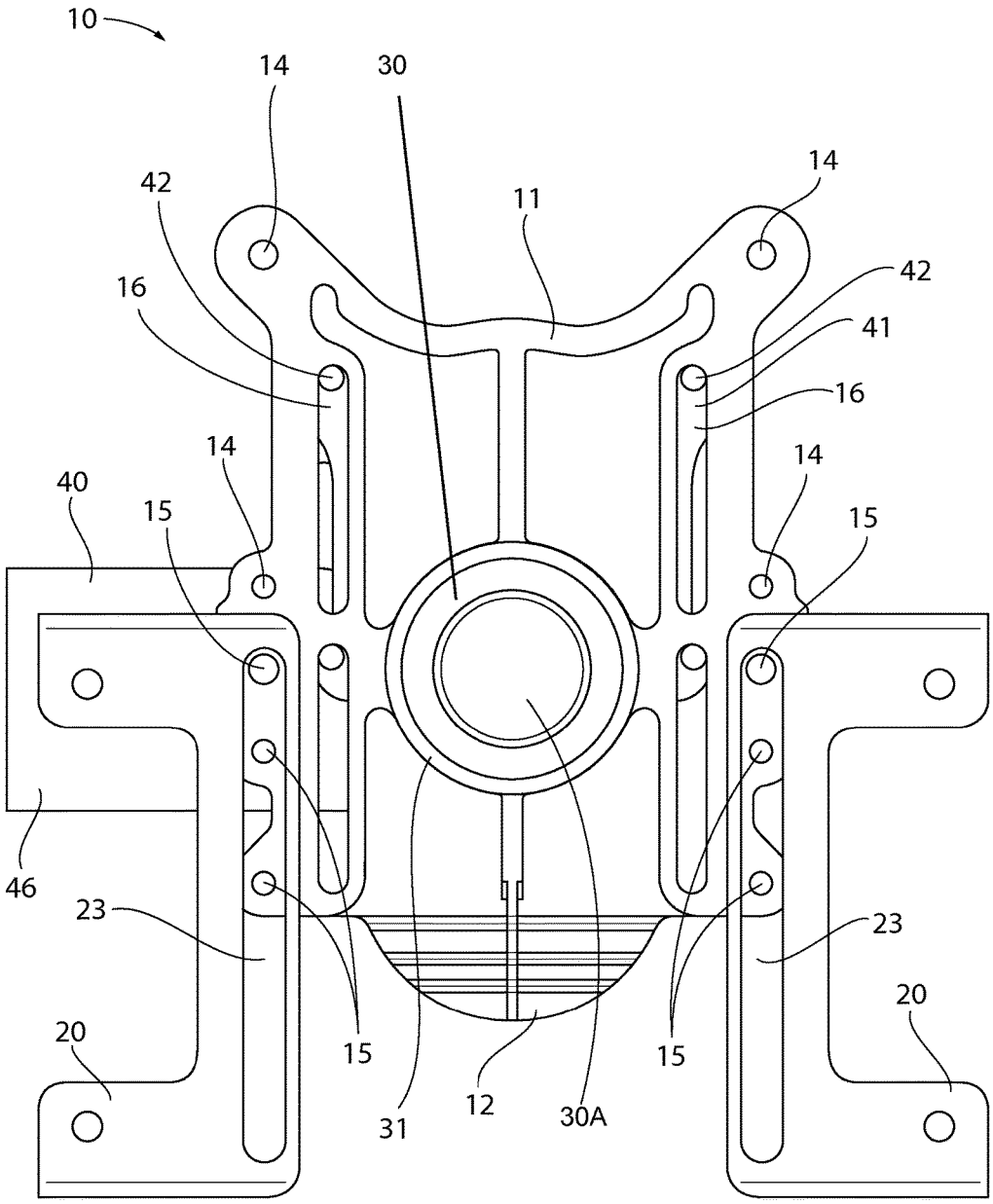
FIG. 3 depicts a front elevational view of the closet carrier system of FIG. 1.
Figure 4:
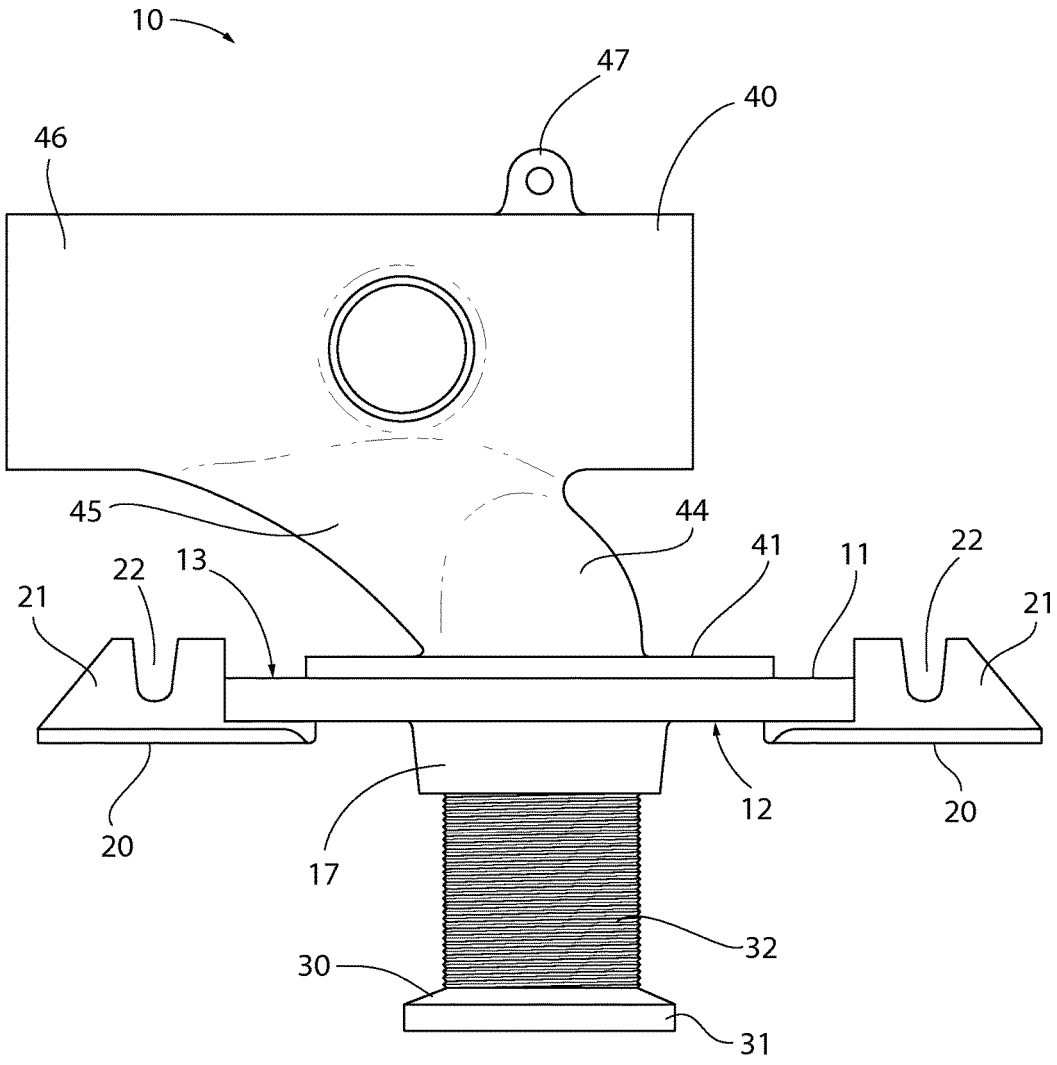
FIG. 4 depicts a top plan view of the closet carrier system of FIG. 1.
Figure 5:
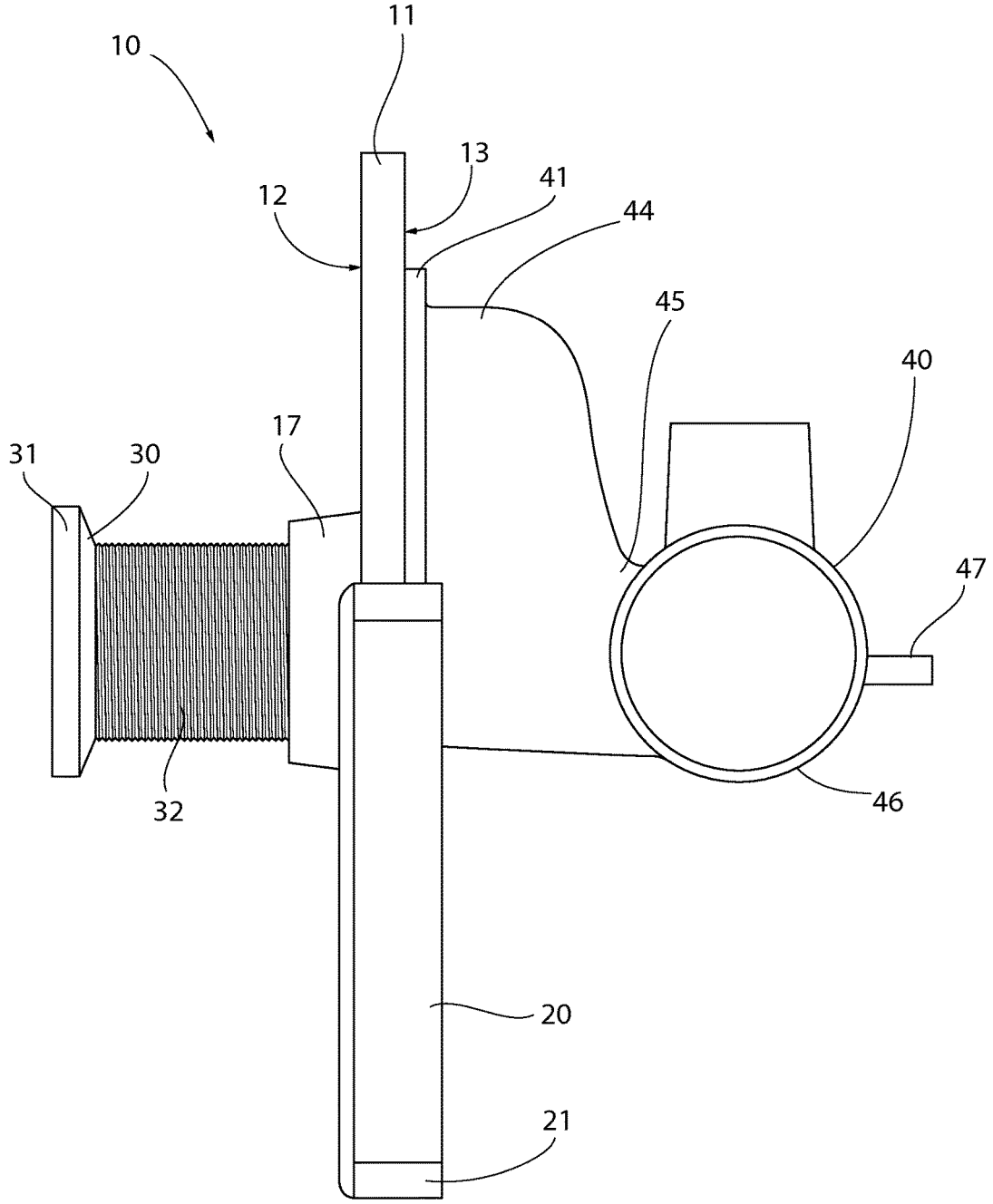
FIG. 5 depicts a right side elevational view of the closet carrier system of FIG. 1.
Figure 6:
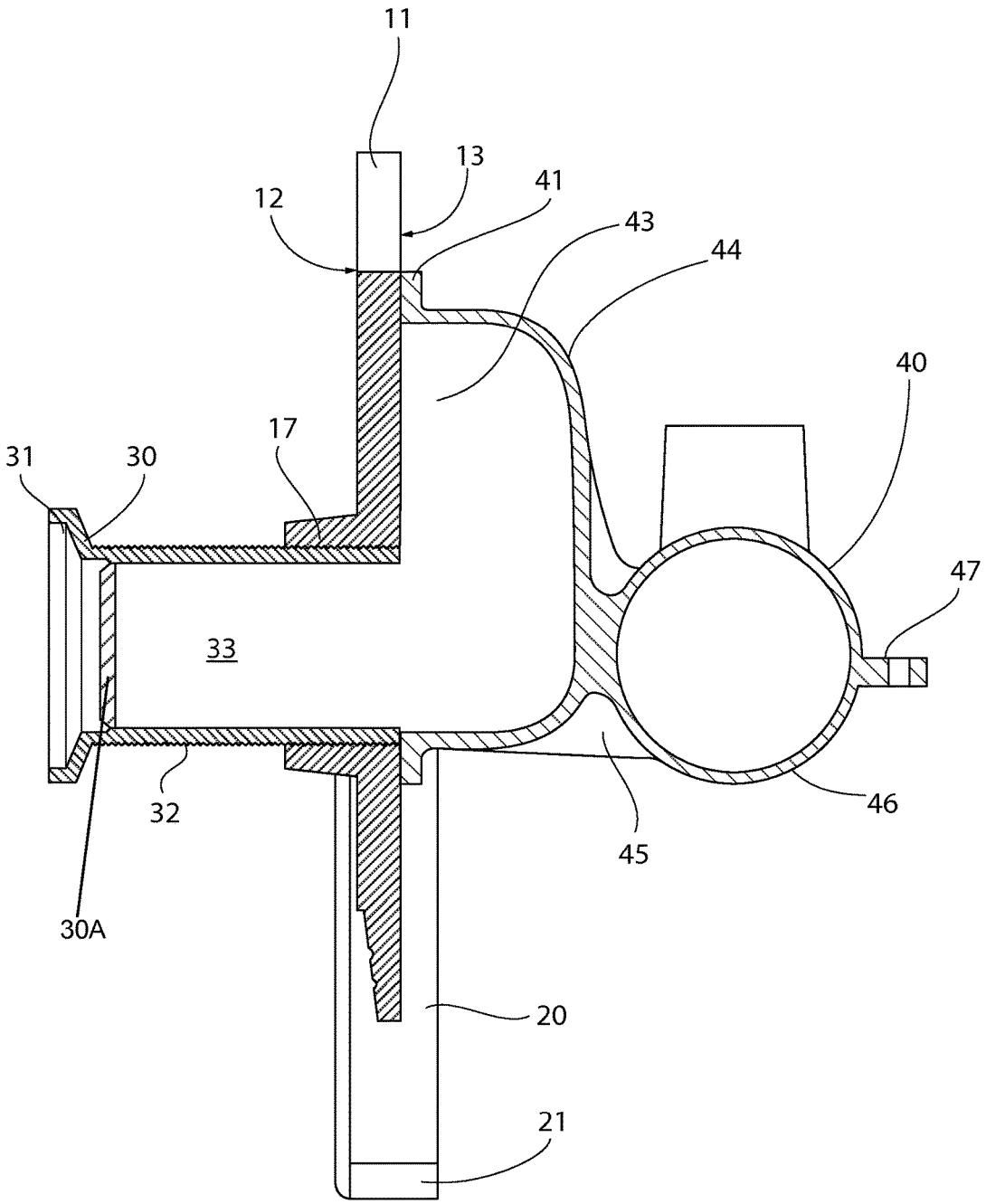
FIG. 6 depicts a cross-sectional side view of the closet carrier system of FIG. 1.

For purposes of the description hereinafter, spatial orientation terms, if used, shall relate to the referenced embodiment as it is oriented in the accompanying drawing figures or otherwise described in the following detailed description. However, it is to be understood that the embodiments described hereinafter may assume many alternative variations and embodiments. It is also to be understood that the specific devices illustrated in the accompanying drawing figures and described herein are simply exemplary and should not be considered as limiting.

With reference to FIGS. 1-9, a closet carrier 10 is shown. The closet carrier system 10 is configured to be connected to a water closet or toilet (not shown) in order to mount and support the water closet on the wall of a structure, and to place the water closet or toilet in fluid communication with a fluid waste system.

As shown in FIGS. 1-9, the closet carrier system 10 includes a faceplate 11 having a first side 12 facing upstream with respect to the flow of waste fluid through the system 10 and a second side 13 facing downstream. The faceplate 11 includes an internally-threaded horn 17 extending from the first side 12 of the faceplate 11. The horn 17 is provided for connecting an adjustable coupling 30 to the faceplate 11, such that the coupling 30 extends from the first side 12 of the faceplate 11. The horn 17 surrounds an opening extending through the faceplate 11 from the first side 12 to the second side 13. The coupling 30 has a hollow cylindrical body that defines an internal passage 33 having an internal diameter ID. The coupling 30 includes a flared fitting 31 that is configured to form a tight fluid connection between the coupling 30 and a discharge port (not shown) of the water closet so that the coupling 30 is placed in fluid communication with the water closet, and waste fluid released from the water closet when the water closet is flushed is conveyed into the internal passage 33 of the coupling 30. The coupling 30 also includes a threaded exterior surface 32 for adjustably connecting the coupling 30 to the horn 17 of the faceplate 11. The horn 17 may include a notch (not shown) defined therein that receives an O-ring (not shown) to seal the engagement between the adjustable coupling 30 and the horn 17. The coupling 30 may further include a knockout diaphragm 30A provided within the internal passage 33. The knockout diaphragm 30A allows for pressure testing of the carrier assembly 10 during installation. After the carrier assembly 10 is assembled and pressure tested, the knockout diaphragm 30A may be dislodged from the internal passage 33 of the coupling 30 and removed.

The faceplate 11 includes at least two threaded holes 14 that are provided for connecting a support arrangement, such as horizontally-extending threaded rods or carriage bolts (not shown), to the faceplate 11. The support arrangement serves to structurally connect the water closet to the faceplate 11 such that the closet carrier system 10 is able to support the weight of the water closet and the user on the structure.

The closet carrier system 10 also includes at least one vertical support 20 connected to the faceplate 11 for supporting the system 10 on a floor surface. According to one particular embodiment, the system 10 includes at least two vertical supports 20 provided on each of the lateral sides of the faceplate 11. Each vertical support 20 includes a foot 21 configured to engage the floor of the structure, wherein the water closet is mounted such that the at least two vertical supports 20 support the weight of the water closet on the floor of the structure. Each foot 21 includes a U-shaped notch 22 defined therein to allow a fastener (not shown) to be passed through the foot 21 in order to fasten the vertical support 20 to the floor of the structure and secure the vertical support 20 in place on the floor. Each of the at least two vertical supports 20 also includes a vertical elongated slot 23, which is provided for receiving fasteners (not shown) to connect the vertical support 20 to the first side 12 of the faceplate 11. The fasteners extend through the elongated slot 23 and engage holes 15 defined in the faceplate 11 in order to adjustably connect the faceplate 11 to the vertical support 20. In this manner, the vertical position of the faceplate 11 with respect to the floor of the structure may be adjusted during installation of the system 10. According to one embodiment, each of the vertical supports 20 may be symmetric in shape with a foot 21 provided at each end of the vertical support 20 such that the vertical support 20 is reversible and may be connected to either one of the right and left sides of the faceplate 11.

The carrier system 10 further includes a waste fitting 40 connected to the second side 13 of the faceplate 11. The waste fitting 40 includes an endplate 41, an inlet 43 defined within the endplate 41, an intermediate portion, and a main body 46 defining a main passageway of the fitting 40. The waste fitting 40 is connected to the second side 13 of the faceplate 11 by way of the endplate 41 that includes holes 42 defined therein for receiving fasteners (not shown) that connect the endplate 41 to the faceplate 11. The faceplate 11 includes vertical elongated slots 16 that receive the fasteners to connect the waste fitting 40 to the faceplate 11, such that the vertical position of the waste fitting 40 with respect to the floor and the faceplate 11 may be adjusted during installation of the system 10. As shown in FIGS. 6-9, the endplate 41 of the fitting 40 is connected to the second side 13 of the faceplate 11, such that the inlet 43 is in fluid communication with the internal passage 33 of the adjustable coupling 30. The inlet 43 of the fitting 40 may have an oblong circular shape having a width or diameter approximately equal to the inner diameter ID of the internal passage 33 of the adjustable coupling 30. The adjustable coupling 30 may be connected to the horn 17 of the faceplate 11 so as to extend through the faceplate 11 and be in direct fluid communication with the inlet 43 of the fitting 40. A gasket (not shown) may be provided between the endplate 41 and the second side 13 of the faceplate 11 in a position surrounding the inlet 43 to seal the engagement between the faceplate 11 and the endplate 41 of the fitting 40. The gasket may be shaped in a corresponding manner to the endplate 41 and may further include holes for the fasteners connecting the faceplate 11 and the endplate 41 to ensure proper alignment of the gasket with the inlet 43 and the adjustable coupling 30.

The waste fitting 40 also includes an oblong circular plenum chamber or bubble 44 at the upstream end thereof on which the endplate 41 is disposed. The interior of the bubble 44 is in fluid communication with the internal passage 33 of the adjustable coupling 30 via the inlet 43 defined in the endplate 41. The waste fitting 40 further includes a sweep passageway 45 extending at an angle from the bubble 44.

The sweep passageway 45 is in fluid communication with the interior of the bubble 44 and the main passageway defined in the main body 46 of the fitting 40. The bubble 44 and the sweep passageway 45 of the fitting 40, in combination, form an intermediate portion of the fitting 40 by which the main passageway of the fitting 40 is placed in fluid communication with the inlet 43 of the fitting 40. The main passageway of the fitting 40, in turn, is configured to be connected with the fluid waste system of the building so as to convey fluid waste from the fitting 40 to the fluid waste system. Accordingly, waste fluid flushed from the water closet is conveyed from the water closet through the internal passage 33 of the adjustable coupling 30 and into the bubble 44 of the waste fitting 40 via the oblong circular-shaped inlet 43. The waste fluid then passes from the bubble 44 through the sweep passageway 45 into the main passageway defined in the main body 46 of the fitting 40 where it is then conveyed into the building's fluid waste system in a manner well known to those having ordinary skill in the art. The waste fitting 40 may further include an anchor support 47 disposed on the main body 46 for connecting the waste fitting 40 to an anchor bar or similar support (not shown) fastened to the floor of the structure in order to anchor the waste fitting 40 to the floor of the structure against the weight of the water closet and a user.

The adjustable coupling 30, the horn 17 of the faceplate 11, and the fitting 40, in particular the bubble 44 and the sweep passageway 45 of the fitting 40, are configured for accommodating a lower flush volume than typical for standard closet carrier systems and specifically to accommodate a flow volume of approximately 1.28 gallons per flush from the water closet. Accordingly, the internal passage 33 of the adjustable coupling 30 has a reduced internal diameter ID that is optimized for encouraging increased flow velocity of the waste fluid through the coupling 30 and evacuating waste through the system 10 such that the flow of waste fluid through the coupling 30 is more efficient. The bubble 44 and the sweep passageway 45 of the waste fitting 40 are similarly optimized such that a smaller volume of waste fluid, specifically 1.28 gallons per flush, can be efficiently and completely conveyed from the water closet to the main passageway defined by the main body 46 of the fitting 40.

More specifically, to achieve more efficient flow of waste fluid through the system 10, the intermediate portion of the fitting 40, in particular the sweep passageway 45, is configured to accelerate the velocity of the flow of waste fluid from the inlet 43 to the main passageway defined in the main body 46 of the fitting 40. The effect of accelerating the flow of waste fluid through the sweep passageway 45 is achieved by configuring the sweep passageway 45 to decrease in size between the bubble 44 and the main passageway defined in the main body 46 of the fitting 40. Decreasing the size of the sweep passageway 45 accelerates the flow of waste fluid through the fitting 40 by converting the pressure of the flow into kinetic energy in a manner similar to the effect of a nozzle on a flow of fluid therethrough. To that end, the sweep passageway 45 is provided with an optimized shape and dimensions to achieve acceleration of the flow of waste fluid to a highest practical velocity for the fitting 40 so that the flow of waste fluid through the fitting 40 is efficiently conveyed to the fluid waste system of the building.

Typically, when a water closet is flushed to dispose of a waste fluid consisting of a mixture of flush water and other liquids and solid and semi-solid materials, the pressure of the flow volume of the waste fluid, typically 1.5-1.6 gallons per flush, is sufficient to carry the entirety of the waste fluid from the water closet through the carrier system to the fluid waste system of the building. For newer water closets designed to utilize a low volume of water per flush, for instance 1.28 gallons per flush, the pressure of the flow of waste fluid from the water closet may be insufficient to carry all of the solid and semi-solid material forming part of the waste fluid from the water closet to the fluid waste system of the building, and the solid and semi-solid materials will become stuck and accumulate within the coupling or the fitting of the carrier, resulting in clogs within the carrier system. The adjustable coupling 30 and the fitting 40, in particular the sweep passageway 45 of the fitting 40, of the closet carrier 10 according to the invention are configured to optimize the flow of waste fluid through the closet carrier 10. The sweep passageway 45 is specifically configured to accelerate the flow of waste fluid through the fitting 40 in order to impart greater kinetic energy to the flow of waste fluid through the closet carrier 10 and thereby carry the solid and semi-solid materials forming part of the waste fluid farther through the closet carrier 10 and break up the solid and semi-solid materials for more efficient conveyance with the liquid portions of the waste fluid.

Figure 7:
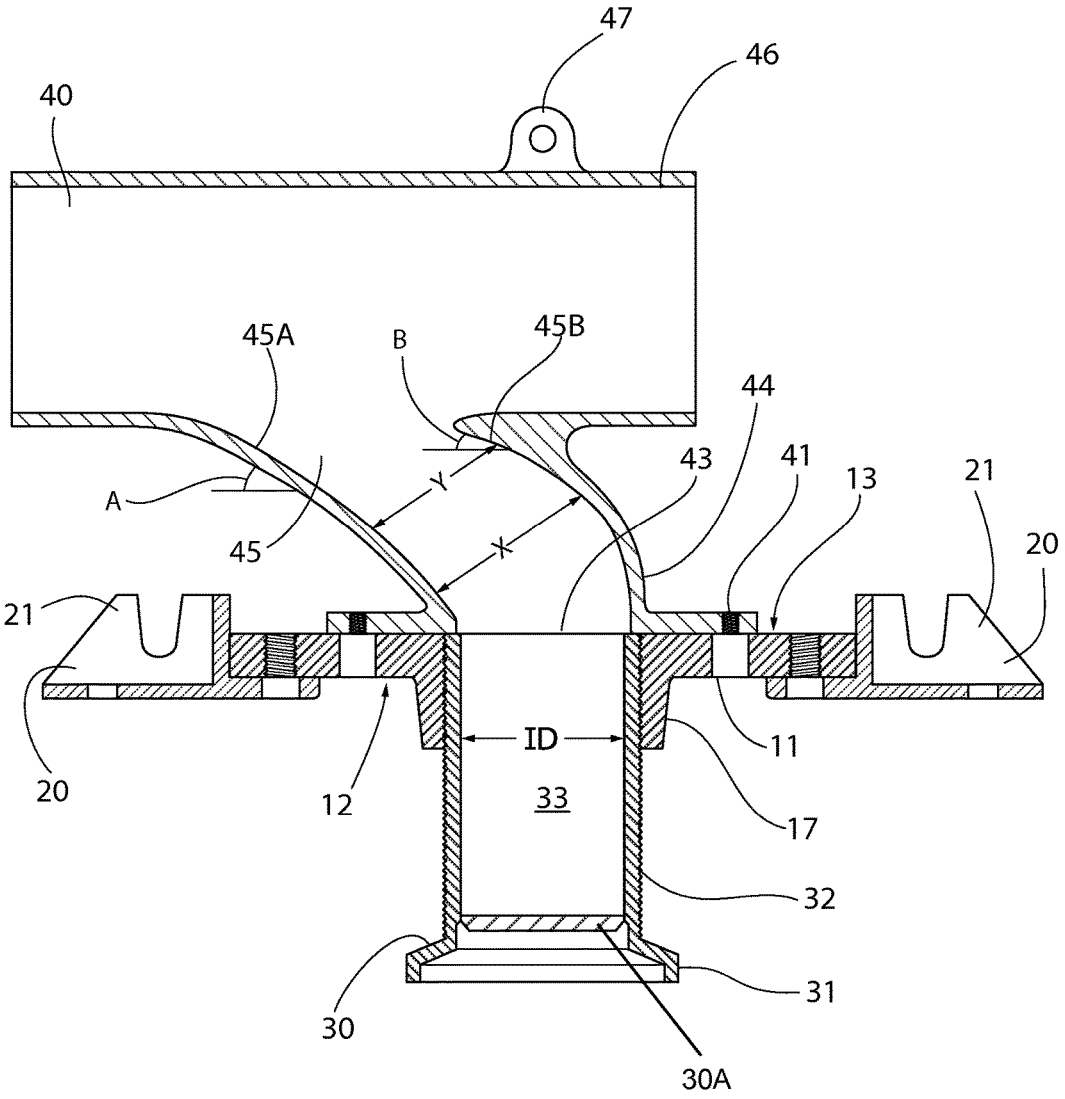
FIG. 7 depicts a cross-sectional top view of the closet carrier system of FIG. 1.
Figure 8:
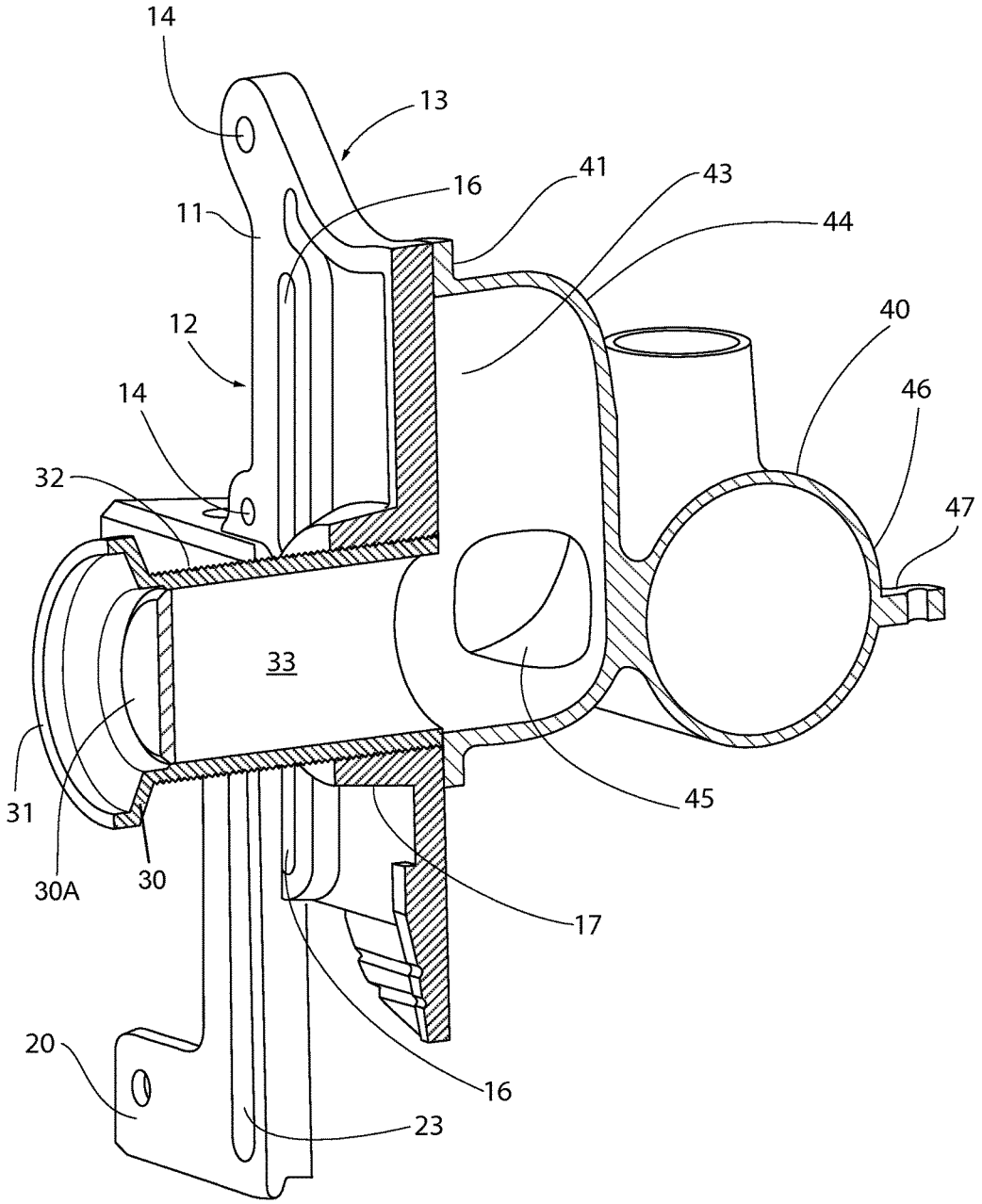
FIG. 8 depicts a perspective view of the cross-sectional side view of FIG. 6.
Figure 9:
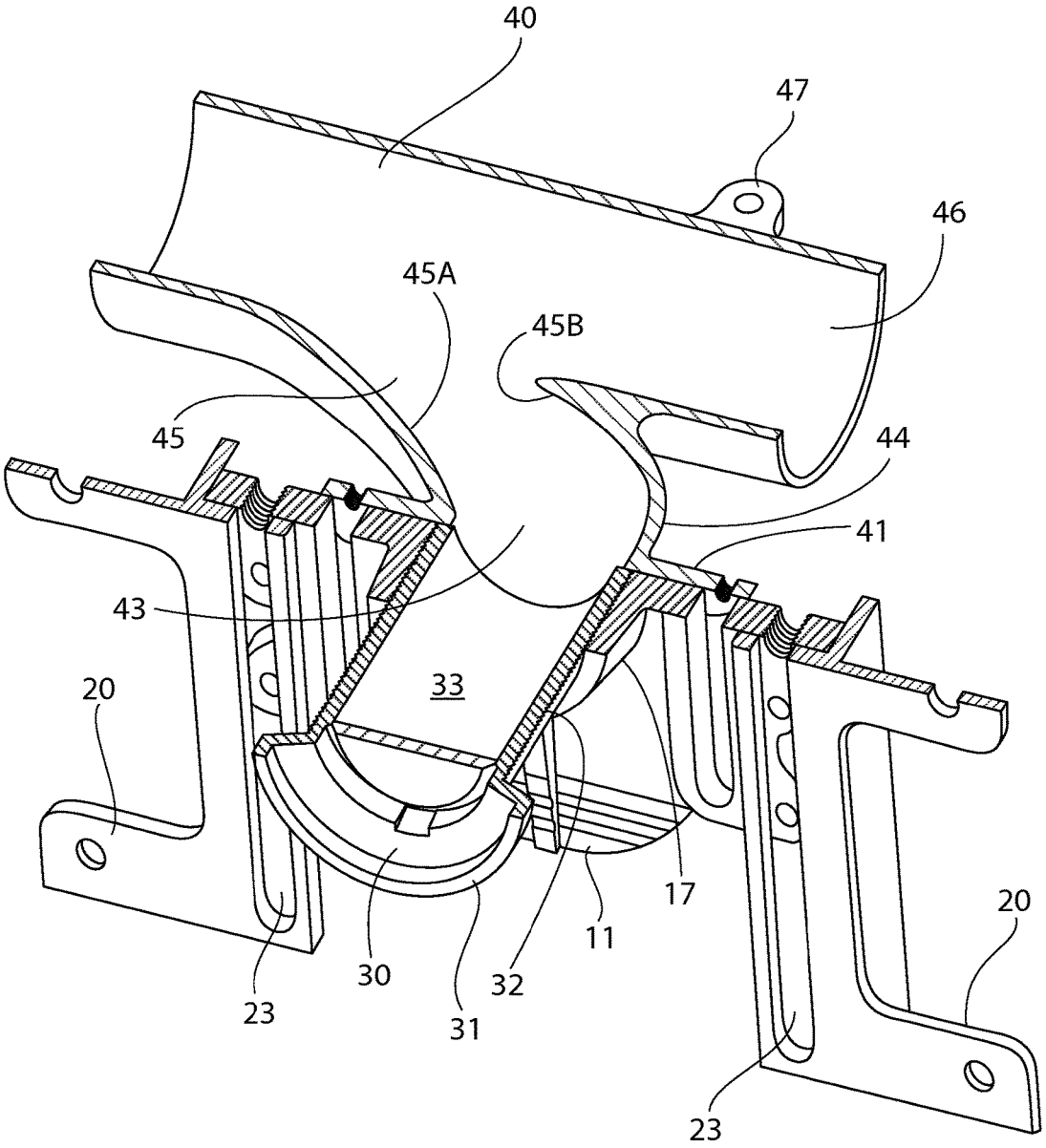
FIG. 9 depicts a perspective view of the cross-sectional top view of FIG. 7.
Figure 10:
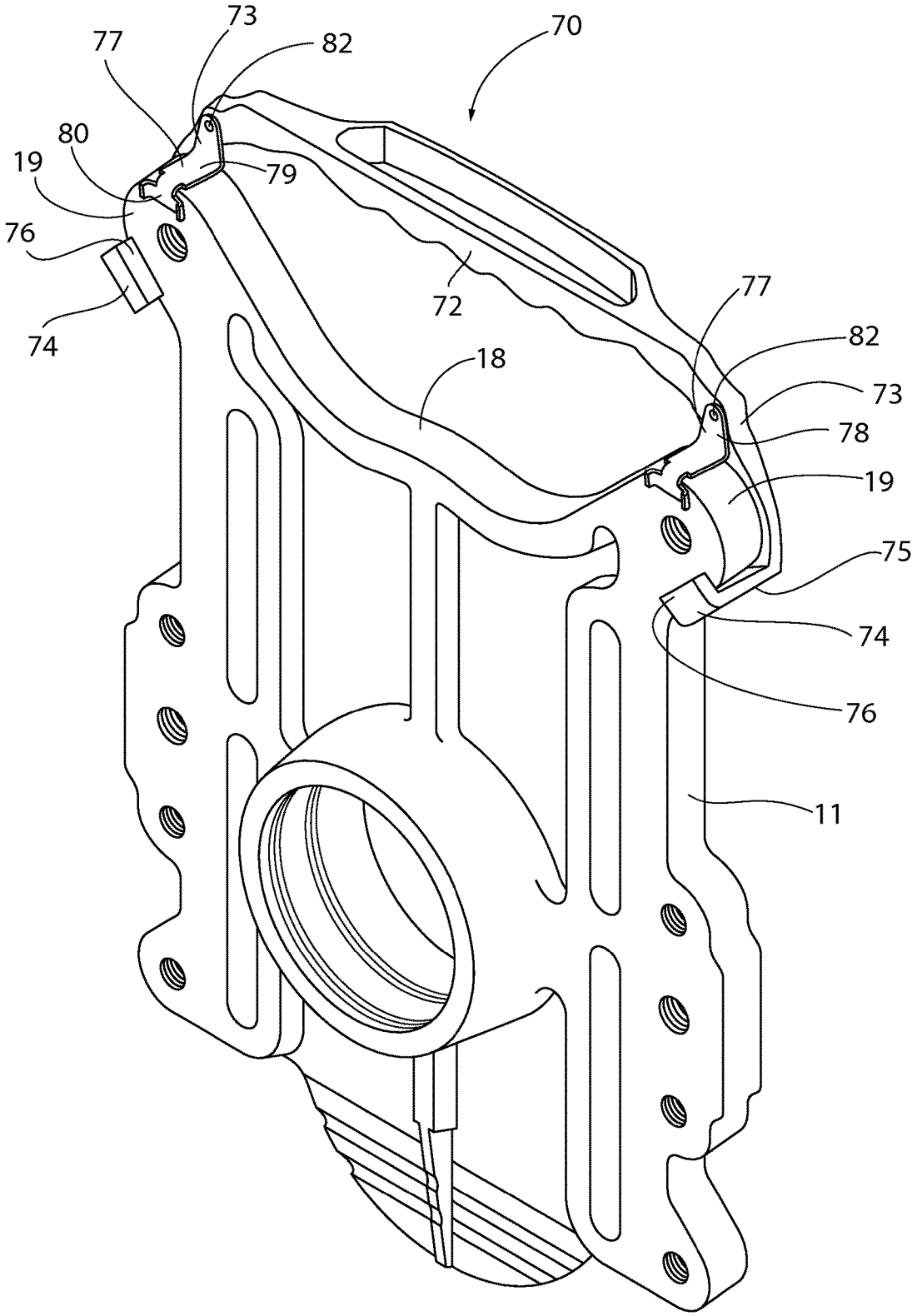
FIG. 10 depicts an upper front perspective view of the faceplate of the closet carrier system of FIG. 1 including a detachable handle assembly made in accordance with the present invention.
Figure 11:
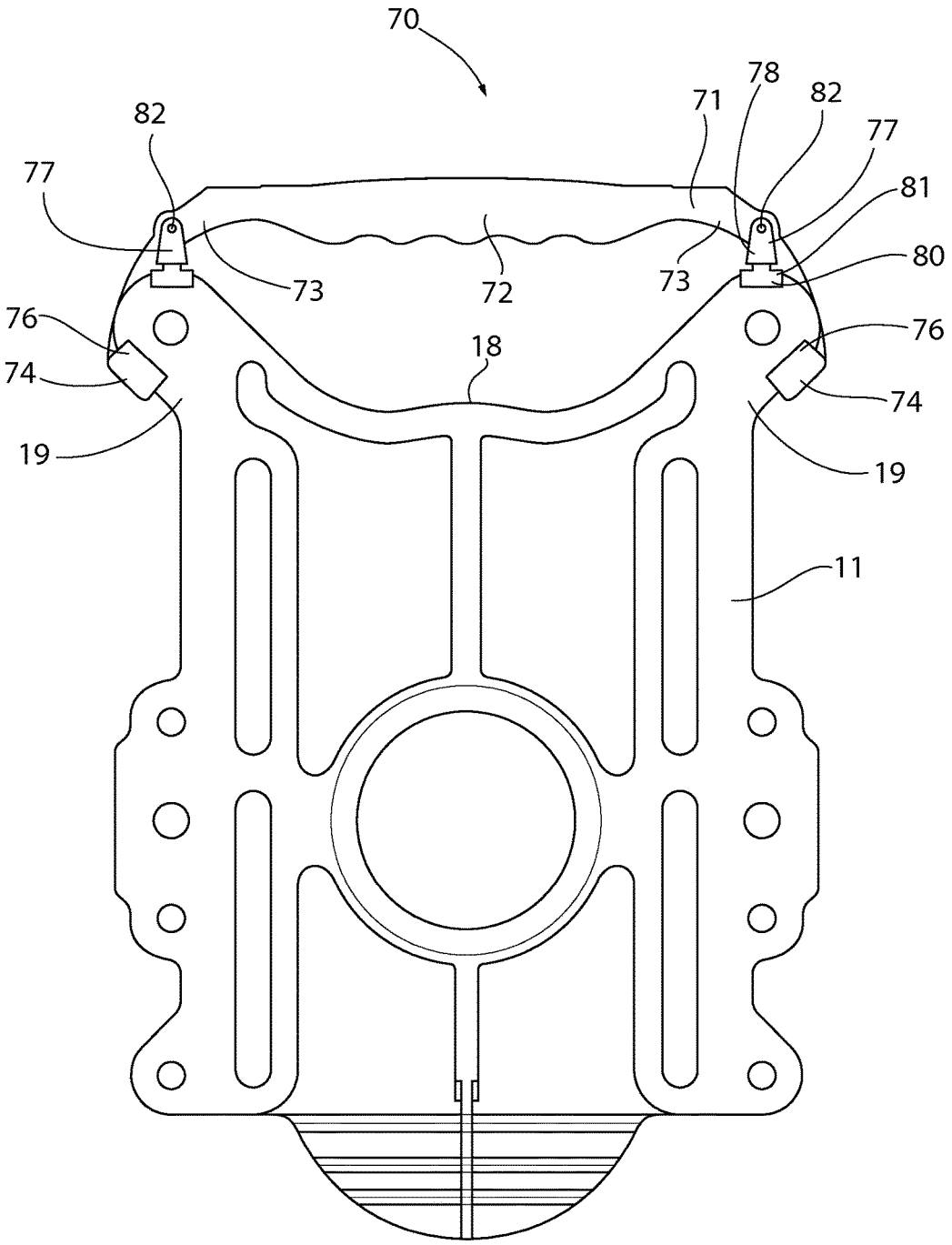
FIG. 11 depicts a front elevational view of the faceplate of the closet carrier system of FIG. 1 including the detachable handle assembly shown in FIG. 10.
Figure 12:
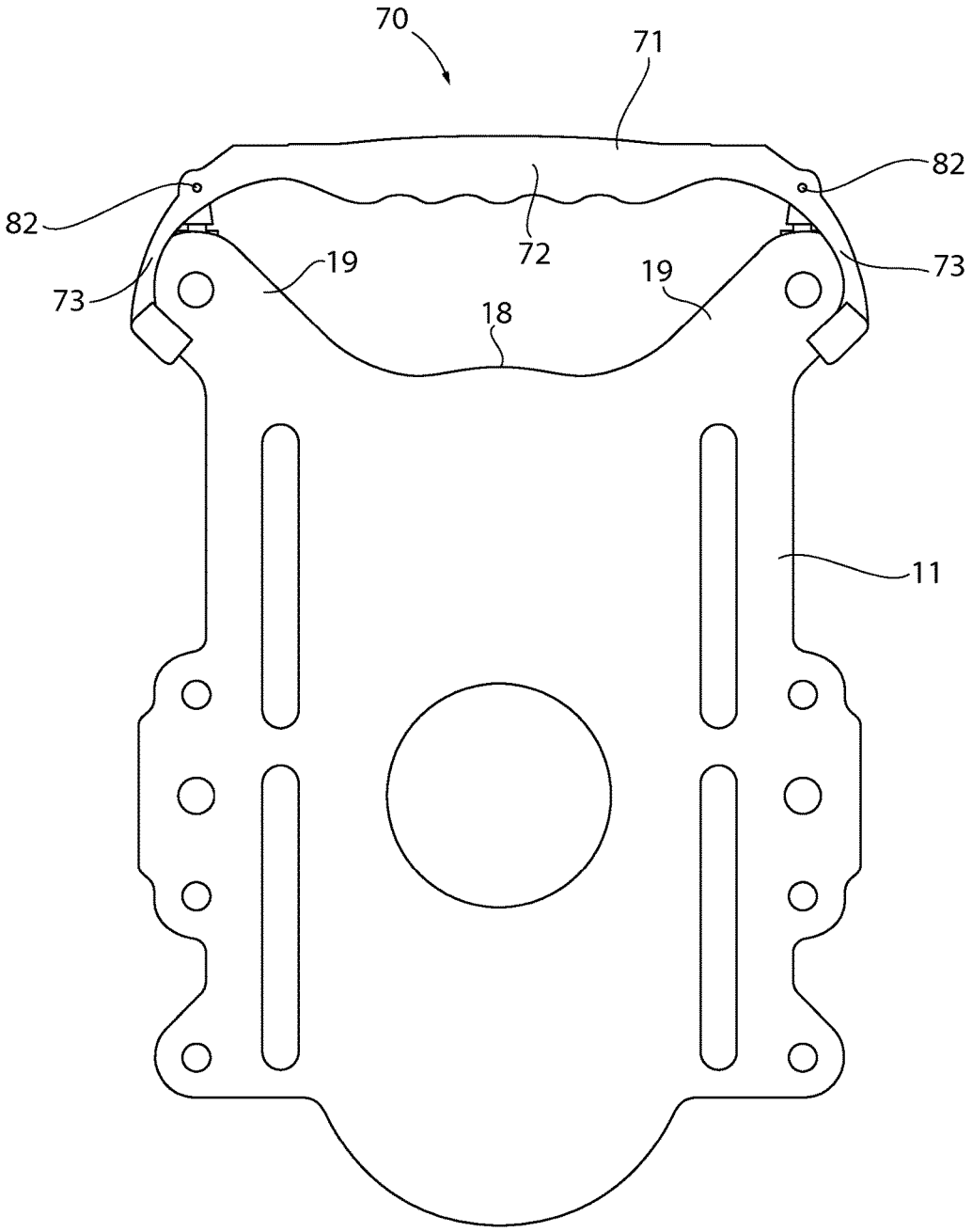
FIG. 12 depicts a rear elevational view of the faceplate of the closet carrier system of FIG. 1 including the detachable handle assembly shown in FIG. 10.
Figure 13:
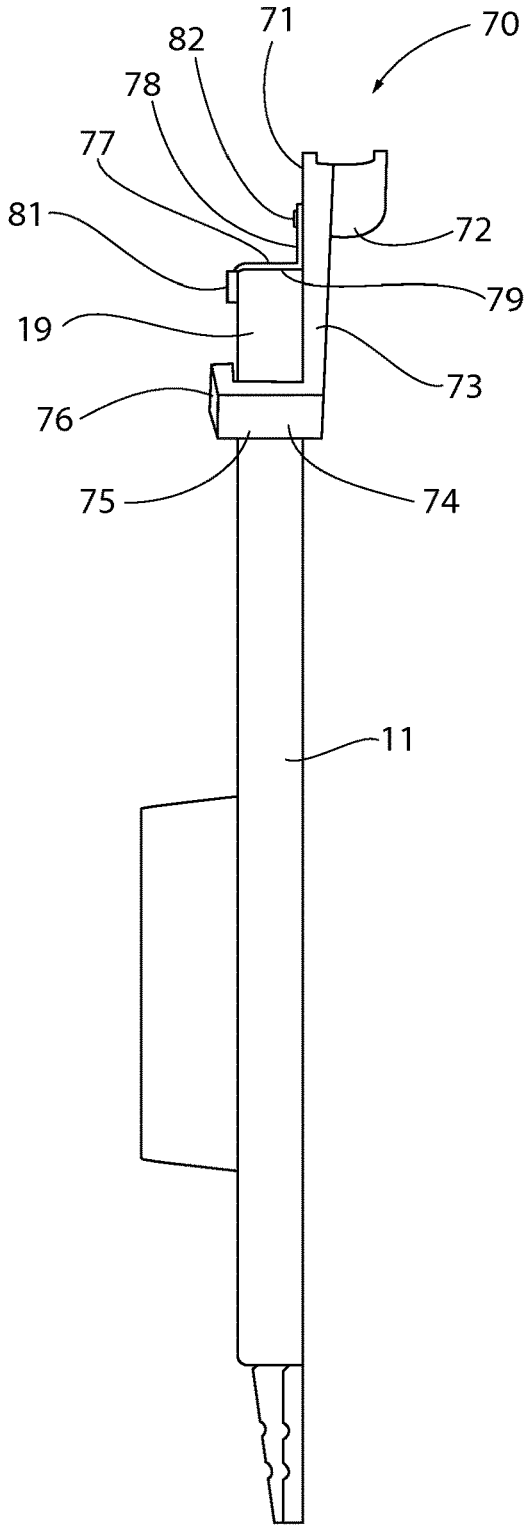
FIG. 13 depicts a right side elevational view of the faceplate of the closet carrier system of FIG. 1 including the detachable handle assembly shown in FIG. 10.
Figure 14:
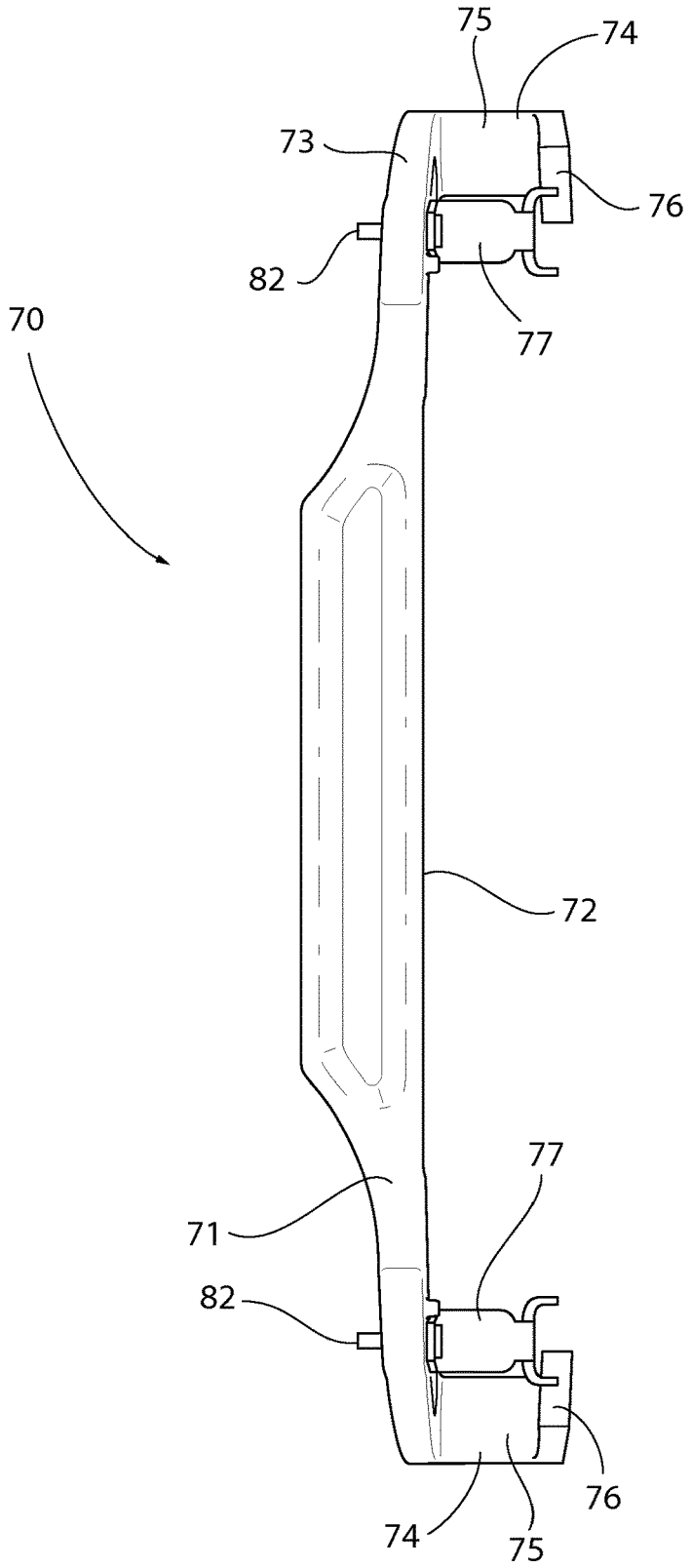
FIG. 14 depicts a top plan view of a detachable handle assembly made in accordance with the present invention.

With reference to FIG. 7, the sweep passageway 45 is at least partially defined by a first internal sidewall 45A substantially extending at a first acute angle A with respect to a plane defined by the endplate 41 of the fitting 40 and a second internal sidewall 45B substantially extending at a second acute angle B with respect to the plane defined by the endplate 41 of the fitting 40. The first acute angle A is greater than the second acute angle B such that the second internal sidewall 45B converges toward the first internal sidewall 45A as the first and second internal sidewalls 45A, 45B extend from the bubble 44 to the main passageway defined in the main body 46. It is to be appreciated that the first and second internal sidewalls 45A, 45B may have slight curvature at a radius significantly larger than their length. Accordingly, the sidewalls 45A, 45B will extend roughly along a tangent extending at the respective angles A, B with respect to the plane defined by the endplate 41 of the fitting 40. It is also to be appreciated that the sweep passageway 45 may also extend from the bubble 44 along a downward angle to the main passageway. According to one embodiment of the invention, the first acute angle A is greater than 30° and the second acute angle B is less than 25°. According to another embodiment of the invention, the first acute angle A is approximately 35.5° and the second acute angle B is approximately 23°. According to yet another embodiment of the invention, a difference between the first acute angle A and the second acute angle B is greater than 10°.

With further reference to FIG. 7, the sweep passageway 45 has a maximum width X between the first internal sidewall 45A and the second internal sidewall 45B at a point within the sweep passageway 45 proximate to the bubble 44, and a minimum width Y between the first internal sidewall 45A and the second internal sidewall 45B at a point within the sweep passageway 45 proximate to the main passageway defined in the main body 46. The maximum width X of the sweep passageway 45 is approximately equal to the inner diameter ID of the internal passage 33 of the adjustable coupling 30, and the minimum width Y of the sweep passageway 45 is less than the maximum width X of the sweep passageway 45 and the internal diameter ID of the adjustable coupling 30. According to one embodiment of the invention, the internal diameter ID of the adjustable coupling 30 and the maximum width X of the sweep passageway 45 are less than or equal to 4 inches and are greater than 2.75 inches, and the minimum width Y of the sweep passageway 45 is greater than or equal to 2.125 inches and less than 2.75 inches. According to another embodiment of the invention, the internal diameter ID of the adjustable coupling 30 and the maximum width X of the sweep passageway 45 are approximately 3 inches, and the minimum width Y of the sweep passageway 45 is approximately 2.25 inches.

It is to be appreciated that the specific dimensions ID, A, B, X, Y described above may be varied within ranges deemed to be suitable by one having ordinary skill in the art to achieve the effect of accelerating the flow of waste fluid through the fitting 40, and efficiently conveying waste fluid through the system 10 to the fluid waste system of the building.

With reference to FIGS. 1-9, a method of conveying waste fluid from a water closet to a fluid waste system includes providing the above-described closet carrier 10 having the faceplate 11, the adjustable coupling 30, the at least two vertical supports 20, and the fitting 40. The method further includes transmitting waste fluid to the intermediate portion of the fitting 40 through the adjustable coupling 30 and the inlet 43 of the fitting 40, and accelerating a velocity of a flow of the waste fluid to the main passageway defined in the main body 46 of the fitting 40 within the intermediate portion of the fitting 40.

As shown in FIGS. 10-14, a detachable handle assembly 70 made in accordance with the present invention may be provided to assist in transportation of the faceplate 11 of the closet carrier system 10 prior to installation.

With reference to FIGS. 10-14, the handle assembly 70 includes a handle body 71 and at least one arm 73 extending from the handle body 71. At least one hook 74 extends from the at least one arm 73. At least one latch 77 is movably attached to the at least one arm 73 proximate to the at least one hook 74. The at least one hook 74 and the at least one latch 77 are configured for mutually engaging and holding at least a portion of an object, such as a projecting portion 19 at a top 18 of the faceplate 11, on the detachable handle assembly 70 in order to assist in lifting and transporting an object, such as the faceplate 11 of the closet carrier system 10. The at least one latch 77 is movable with respect to the arm 73 and the hook 74 to selectively engage and disengage at least a portion of the object, such as the projecting portion 19 of the faceplate 11.

More particularly, as shown in FIGS. 10-14, the handle body 71 has an elongated shape defining a central gripping portion 72. At least two arms 73 are disposed on opposite ends of the central gripping portion 72 such that one arm 73 extends outwardly from each end of the central gripping portion 72. At least two hooks 74 each extend from a respective one of the at least two arms 73. According to one aspect of the invention, the at least two arms 73 each terminate in a hook 74 extending from an end of the respective arm 73. Each hook 74 includes a base portion 75 extending horizontally outward from the arm 73 and a terminal portion 76 extending in a substantially perpendicular direction from the base portion 75. The base portion 75 has a length that is equal to or slightly larger than the thickness of the projecting portions 19 of the faceplate 11. The arm 73 and the hook 74 together form a U-shaped channel configured to receive and support at least a portion of the object engaged by the handle assembly 70, such as the projecting portion 19 of the faceplate 11.

The central gripping portion 72 may include at least one ergonomic feature, such as an opening and/or ridges as shown in FIGS. 10-12 and 14, to accommodate a user's fingers when using the handle assembly to transport the faceplate 11 in order to facilitate gripping of the central gripping portion 72.

Figure 15:
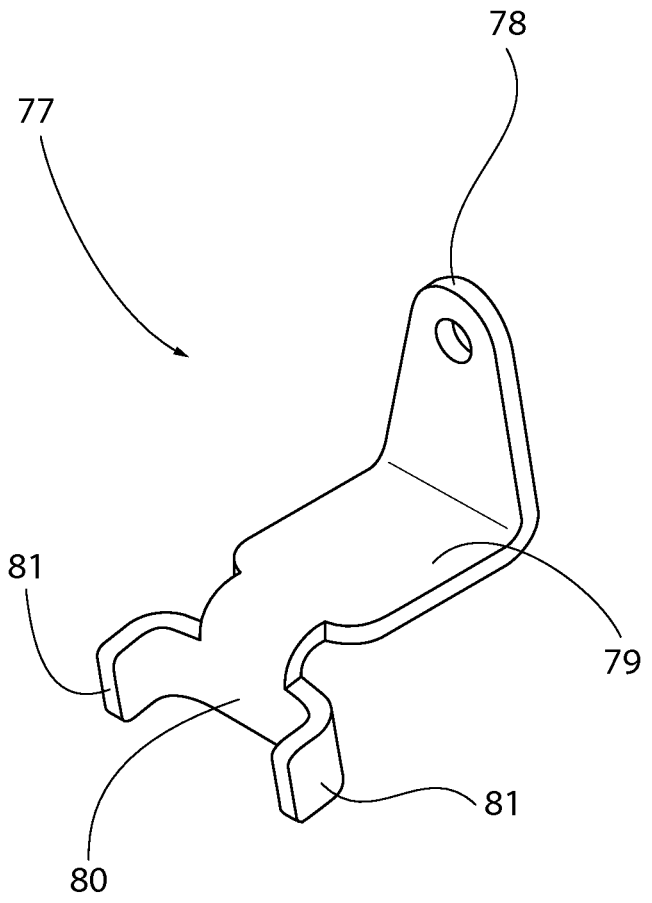
FIG. 15 depicts an upper front perspective view of a latch of the detachable handle assembly of FIG. 14.

As shown in FIGS. 10-14, the at least one latch 77 includes at least two latches 77, each movably attached to a respective arm 73 proximate to the respective hook 74. A latch 77 is shown in detail in FIG. 15. The latch 77 includes a first vertical portion 78, a horizontal portion 79 extending outwardly from the first vertical portion 78, and a second vertical portion 80 extending in a downward direction from the horizontal portion 79. The first vertical portion 78 and the second vertical portion 80 extend in directions that are substantially parallel to one another, and the horizontal portion 79 extends in a direction that is substantially perpendicular to the directions in which the first vertical portion 78 and the second vertical portion 80 extend. The first vertical portion 78 extends away from the horizontal portion 79 in a direction that is substantially opposite to the direction in which the second vertical portion 80 extends away from the horizontal portion 79. The horizontal portion 79 has a length that is equal to or slightly larger than the thickness of the projecting portions 19 of the faceplate 11.

Each latch 77 is attached to the respective arm 73 using a suitable fastener 82, such as a rivet, that allows the latch 77 to be rotated with respect to the respective arm 73. Each latch 77 may include at least one portion to facilitate handling and movement thereof. According to one aspect of the invention, each latch 77 includes at least one tab 81 extending outwardly from the second vertical portion 80 to provide a surface to assist the user when manually rotating the latch 77. It is to be appreciated that the portion of the latch 77 to facilitate handling and movement thereof may be of any configuration suitable for grasping and manual movement of the latch 77 as it engages and disengages the faceplate 11.

As can be seen in FIGS. 10-13, when the handle assembly 70 is connected to the faceplate 11, each of the projecting portions 19 of the faceplate 11 rest on the base portions 75 of the hooks 74. The terminal portions 76 of the hooks 74 extend around the front exterior surface of the projecting portions 19, and the arms 73 are positioned behind the rear exterior surface of the projecting portions 19 such that the projecting portions 19 are positioned within the U-shaped channels formed by the arms 73 and the hooks 74. The latches 77 may be rotated out of the way to allow the projecting portions 19 of the faceplate 11 to be inserted into the hooks 74.

Once the projecting portions 19 are positioned in the hooks 74, the latches 77 can be rotated to the position shown in FIGS. 10-13 using the at least one tab 81 to engage the projecting portions 19. In this position, the horizontal portions 79 of the latches 77 are positioned above the top edge of the projecting portion 19, and the second vertical portions 80 of the latches 77 extend around the front exterior surface of the projecting portions 19. The arms 73 are positioned behind the rear exterior surface of the projecting portions 19.

As can be seen in FIGS. 10-13, the spacing between and placement of the hooks 74 and latches 77 relative to one another is adapted to conform with the geometry of the projecting portions 19 of the faceplate 11 such that the projecting portions 19 rest within the U-shaped channel formed by the hooks 74, and the arms 73 and the latches 77 assist in keeping the projecting portions 19 within the U-shaped channel formed by the hooks 74 and the arms 73. It is to be appreciated that the arms 73, the hooks 74, and the latches 77 may be formed in any one of a number of configurations suitable for engaging objects, particularly faceplates of closet carrier systems, of different configurations.

The terminal portions 76 of the hooks 74, the second vertical portions 80 of the latches 77, and the arms 73 cooperate to hold the projecting portions 19 on the base portions 75 of the hooks 74 such that the central gripping portion 72 of the handle assembly 70 can be used to lift and carry the faceplate 11. After the faceplate 11 has been moved, the handle assembly 70 can be disconnected from the faceplate 11 by rotating the latches 77 to disengage the projecting portions 19 and removing the projecting portions 19 from the hooks 74 of the handle assembly 70.

With reference to FIGS. 1-15, a method of assembling a closet carrier system 10 for a water closet is provided in accordance with an embodiment of the present invention. The method includes providing a faceplate 11; providing at least one vertical support 20, the at least one vertical support 20 being configured to be adjustably connected to the faceplate 11 for supporting the carrier system 10 on a floor surface; providing a coupling 30, the coupling 30 being configured to be adjustably connected to the faceplate 11, and configured to be connected to the water closet and placed in fluid communication therewith; providing a detachable handle; connecting the detachable handle to at least a portion 19 of the faceplate 11; and lifting and transporting at least the faceplate 11 by the detachable handle to an installation site. The detachable handle may include a detachable handle assembly 70, which is described above with reference to FIGS. 10-15. The detachable handle assembly 70 includes a handle body 71; at least one arm 73 extending from the handle body 71; at least one hook 74 extending from the at least one arm 73; and at least one latch 77 movably attached to the at least one arm 73 proximate to the at least one hook 74.

While specific embodiments of the invention have been described in detail, it will be appreciated by those having ordinary skill in the art that various modifications and alternatives to those details could be developed in light of the overall teachings of the disclosure. The presently preferred embodiments described herein are meant to be illustrative only and not limiting as to the scope of the invention, which is to be given the full breadth of the appended claims and any and all equivalents thereof. Specifically, it should be understood that the detachable handle assembly can be used to transport other objects, particularly other faceplate/closet carrier designs, and is not limited to the closet carrier as disclosed in FIGS. 1-9.

The invention claimed is:

1. A closet carrier system for a water closet, comprising:
- a faceplate;
- a coupling connected to and extending from the faceplate, the coupling being configured to be connected to the water closet and placed in fluid communication therewith;
- at least one vertical support connected to the faceplate for supporting the system on a floor surface; and
- a detachable handle assembly for connection to at least a portion of the faceplate, the detachable handle assembly comprising:
  - a handle body having an elongated shape defining a central gripping portion;
  - at least one arm extending from the central gripping portion;
  - at least one hook extending from the at least one arm; and
  - at least one latch movably attached to the at least one arm proximate to the at least one hook,
- wherein the at least one hook and the at least one latch are configured for mutually engaging and holding at least a portion of the faceplate and wherein the detachable handle assembly is configured for lifting and transporting the faceplate.

2. The closet carrier system according to claim 1, wherein the at least one latch is movable with respect to the arm and the at least one hook to selectively engage and disengage at least a portion of the faceplate.

3. The closet carrier system according to claim 1, wherein the at least one hook and the at least one arm define a U-shaped channel configured to receive and support at least a portion of the faceplate.

4. The closet carrier system according to claim 1, wherein the at least one arm of the assembly comprises at least two arms disposed on opposite ends of the central gripping portion.

5. The closet carrier system according to claim 4, wherein the at least one hook comprises at least two hooks, each extending from a respective one of the at least two arms, and the at least one latch comprises at least two latches, each movably attached to a respective one of the at least two arms proximate to the respective at least one hook.

6. A method of assembling a closet carrier system for a water closet comprising:
- providing a faceplate;
- providing at least one vertical support, the at least one vertical support being configured to be adjustably connected to the faceplate for supporting the carrier system on a floor surface;
- providing a coupling, the coupling being configured to be adjustably connected to the faceplate, and configured to be connected to the water closet and placed in fluid communication therewith;
- providing a detachable handle, wherein the detachable handle comprises a detachable handle assembly, comprising:
- a handle body;
- at least one arm extending from the handle body;
- at least one hook extending from the at least one arm; and
- at least one latch movably attached to the at least one arm proximate to the at least one hook;
- connecting the detachable handle to at least a portion of the faceplate, wherein the at least one hook and the at least one latch are configured for mutually engaging and holding the at least a portion of the faceplate; and
- lifting and transporting at least the faceplate by the detachable handle to an installation site.

* * * * *